United States Patent [19]

Blanke, Jr.

[11] 4,027,777

[45] June 7, 1977

[54] PAIL ASSEMBLIES

[76] Inventor: Richard H. Blanke, Jr., 1224 Dubray Court, Kirkwood, Mo. 63022

[22] Filed: Oct. 6, 1975

[21] Appl. No.: 619,633

[52] U.S. Cl. ..... 220/295; 215/DIG. 1; 220/298

[51] Int. Cl.[2] ..... B65D 41/06

[58] Field of Search ..... 220/293, 298, 308, 355, 220/295, 301, 304, 74; 215/237, DIG. 1

[56] References Cited

UNITED STATES PATENTS

| | | | |
|---|---|---|---|
| 2,071,266 | 2/1937 | Schmidt | 220/301 |
| 2,241,381 | 5/1941 | Hothersall | 220/301 |
| 3,127,049 | 3/1964 | Welty et al. | 220/304 |
| 3,167,210 | 1/1965 | Carney, Jr. | 220/304 |
| 3,297,192 | 1/1967 | Swett | 220/355 |
| 3,371,817 | 3/1968 | Gasbarra et al. | 220/298 |
| 3,428,208 | 2/1969 | Kosar | 215/DIG. 1 |
| 3,432,058 | 3/1969 | Burgess | 220/301 |
| 3,433,385 | 3/1969 | Metivier | 220/293 |
| 3,458,079 | 7/1969 | Gasbarra | 220/308 |
| 3,470,927 | 10/1969 | Craig | 150/.5 |
| 3,510,023 | 5/1970 | Ullman et al. | 220/308 |
| 3,516,571 | 6/1970 | Roper et al. | 220/74 |
| 3,532,244 | 10/1970 | Yates, Jr. | 215/DIG. 1 |
| 3,692,208 | 9/1972 | Croyle et al. | 220/355 |
| 3,780,898 | 12/1973 | Menkel | 215/337 |

*Primary Examiner*—William Price

*Assistant Examiner*—Allan N. Shoap

*Attorney, Agent, or Firm*—Polster and Polster

[57] ABSTRACT

A pail assembly, preferably all plastic, is provided in which a pail has peripherally spaced pail lugs on its side wall adjacent the rim of the pail. The pail lugs have an inclined cam surface at one end and a bearing surface substantially parallel to the rim along a margin remote from the rim. A lid has an internal annular skirt on and integral with it, of a shape and outside diameter complementary to the inside surface of the pail side wall adjacent the rim so that the skirt and pail surface engage one another snugly when the lid is rotated into mounted condition on the pail. The lid has an annular flange integral with it, spaced radially outboardly of the skirt and defining with the skirt a channel having a closed bottom wall and an open mouth. A plurality of peripherally spaced, radially inwardly extending lugs are formed integrally with the flange. They are spaced axially outwardly from the closed bottom wall of the channel and are of a peripheral length less than the space between successive pail lugs with which the flange lugs are to engage. Sealing means, preferably an annular tubular gasket, are provided between the channel bottom wall and the rim of the pail, the sealing means being in compression when the pail lug bearing surface and flange lug bearing surface are engaged by a turn of the required number of degrees.

5 Claims, 7 Drawing Figures

PAIL ASSEMBLIES

BACKGROUND OF THE INVENTION

Plastic buckets are used in large numbers, particularly for transporting and thereafter holding corrosive liquids such as supersaturated salt solutions. It is important to seal such containers securely, and to be able to unseal them safely.

One of the objects of this invention is to provide an improved pail assembly by which a lid can be mounted securely to provide an effective seal, and removed easily, and which will not work its way loose in transit during shipment.

Other objects will become apparent to those skilled in the art in light of the following description and accompanying drawings.

SUMMARY OF THE INVENTION

In accordance with this invention generally stated, in a pail assembly including a pail having a side wall with a rim circular in top plan, and a plastic lid capable of being sealingly mounted on the pail, a plurality of peripherally spaced pail lugs are provided on the side wall adjacent the rim, each of the pail lugs having an inclined cam surface at one end and a bearing surface substantially parallel with the rim along a margin of the lugs remote from the rim. The lid has an integral annular skirt of a shape and outside diameter complementary to the inside surface of the pail side wall adjacent the rim, dimensioned to engage the side wall snugly when the lid is mounted on the pail. The lid also has an annular flange spaced outboardly radially of the skirt and defining with the skirt a channel having a closed bottom wall and an open mouth. A plurality of peripherally spaced, radially inwardly extending flange lugs, integral with the flange and spaced axially outwardly from the closed bottom wall toward the open mouth of the channel have a peripheral length less than the space between successive pail lugs with which the flange lugs are to engage. The flange lugs have a bearing surface extending radially inwardly and spaced and positioned to engage the pail lug bearing surface. Sealing means are provided between the channel bottom wall and the rim of the pail, the sealing means being put into compression when the pail lug bearing surface and the flange lug bearing surface are engaged by rotating the lid relative to the pail. The pail lug and flange lug bearing surfaces are under-bevelled in a direction radially inwardly, to form a radial interlock when the lid is mounted.

Preferably the sealing means are a hollow annulus, seated in a seat at the bottom wall of the channel, an annular nose is provided in the lid channel bottom wall, which bears on the sealing means, an annular uninterrupted rib extends around the rim of the pail and another rib, interrupted between lugs, extends around the pail radially outboardly of the uninterrupted rib, the nose of the lid being substantially centered between the two ribs when the lid is mounted. Also preferably, the inside surface of the side wall of the pail adjacent the rim is sloped radially inwardly in the direction away from the rim, and the annular lid skirt is also sloped so as to provide a wedging seal and easy entrance of the skirt.

Preferably, gussets, integral with the lid web and skirt, add strength to the lid, and also ensure by their reinforcement, the fit of the skirt with the inside surface of the pail side wall.

DESCRIPTION OF THE PREFERRED EMBODIMENT

Figure 1:
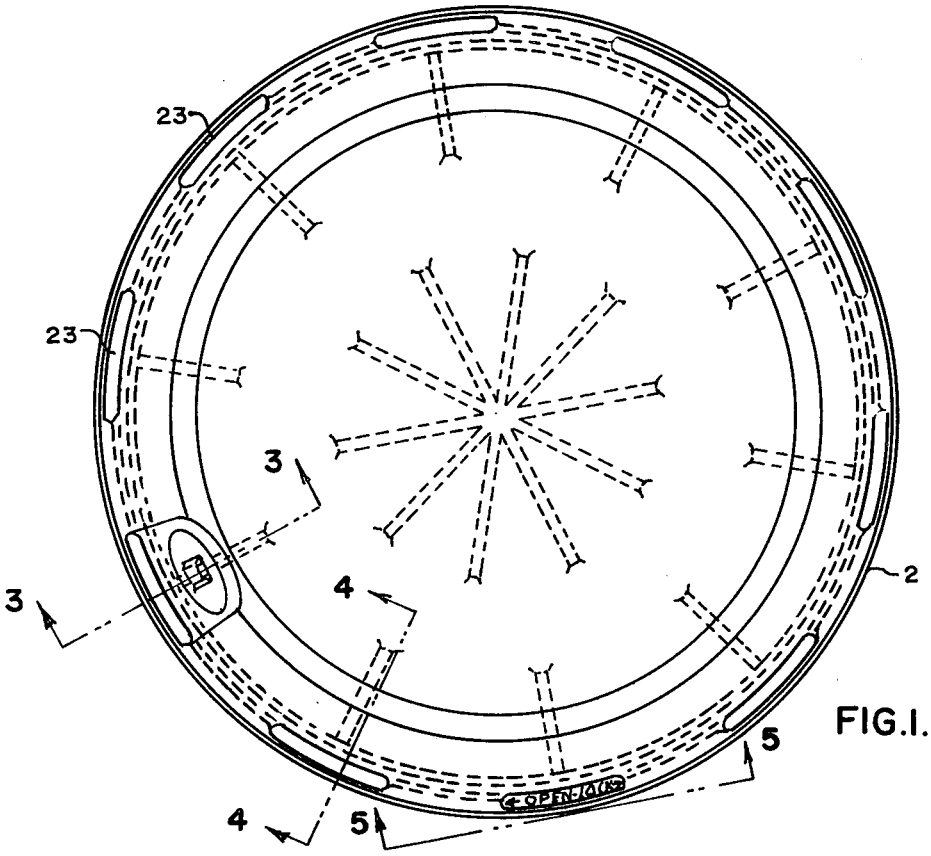
FIG. 1 is a top plan view of one embodiment of pail assembly of this invention.
Figure 2:
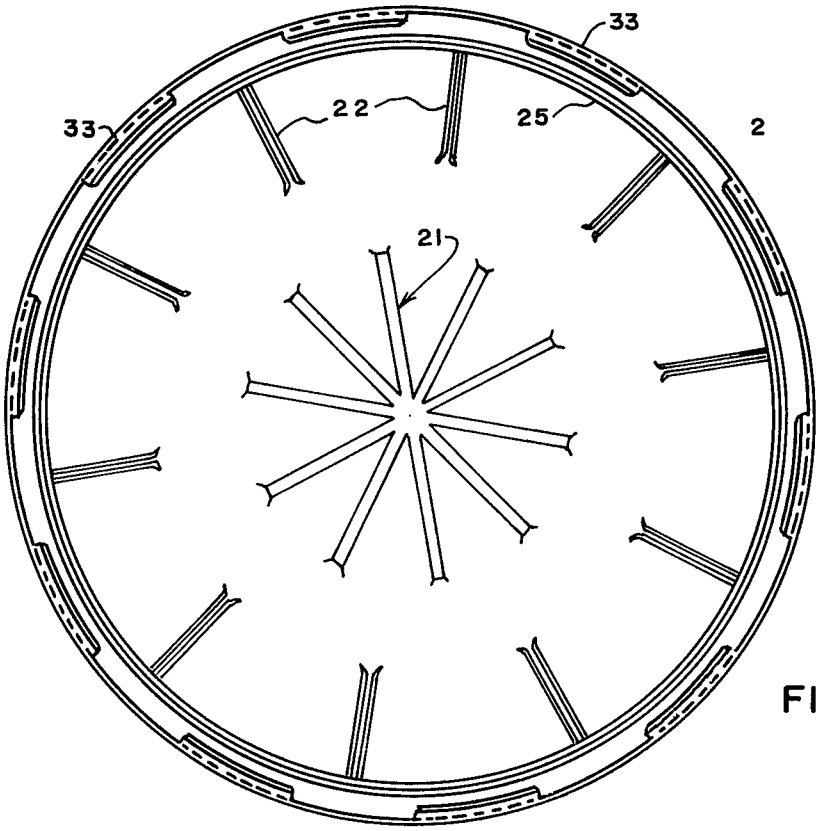
FIG. 2 is a bottom plan view of the lid of the pail assembly shown in FIG. 1.

Referring now to the drawing for one illustrative embodiment of pail assembly of this invention, reference numeral 1 indicates a pail, and reference numeral 2 indicates a lid.

The lid 2 has a web part 20 interrupted in the embodiment shown by an opening defined by an internally pipe threaded ring 4, set in a pouring well 5 and stopped with a pipe threaded plug or bung 3.

The pail or bucket 1 has a side wall 6 with an uninterrupted rim 7 at its outer edge. The rim 7 has on it an annular rib 8 which runs uninterruptedly around the rim.

On its radially inner side, the pail side wall 6 has a sloping portion 9 extending from the rim in the direction of the bottom of the pail. On the outer surface of the side wall 6, extending axially from the rim, are pail lugs 10. In the embodiment shown, there are ten lugs 10, regularly spaced around the periphery of the pail, separated from one another by a space as long as the lugs.

Each of the pail lugs has a cam surface 11 sloping from the level of the rim in a direction away from the rim to a bearing surface 12, and a stop 13. The bearing surface 12 has an under bevel, so that the radially inner part of the bearing surface is closer to the rim than the radially outer part. The bearing surface 12 is substantially parallel with the rim. The stop 13 projects beyond the outer edge of the bearing surface 12, and preferably extends radially to block the under bevel of the bearing surface 12.

In this embodiment, a lug rib 14 extends through the length of each lug along the rim parallel with and spaced radially outwardly from the rib 8.

The web 20 of the lid 2 has on its under side a reinforcing spider 21, with 10 spoke-like ribs, and 10 reinforcing gussets 22 spaced radially outwardly from the spider and centered peripherally between successive spokes of the spider. The reinforcing gussets, like the spider, are integral with the web 20, and the gussets are integral with an interior, uninterrupted, annular skirt 25. As is shown most clearly in FIGS. 3 and 4, the skirt 25 is angled and dimensioned complementarily to the sloping portion 9 of the side wall of the pail, to form a snug, sealing fit with the side wall when the lid is mounted on the pail.

The skirt 25 is made integral with the web 20. Also integral with the web 20 is an uninterrupted annular flange 26, spaced radially outwardly from the skirt 25 and defining with the skirt a channel with an open mouth 30 and a bottom wall 27. In this embodiment, the bottom wall 27 and inside side walls of the skirt and flange defines between them two semi-cylindrical channels 28 and an intermediate nose 29. On the outer side of the bottom wall 27, are spaced bosses 23. At the radially outer edge of the mouth end of the flange 26 is a bead 31.

At regularly spaced intervals, the flange 26 has integral with it flange lugs 33, each with an under beveled bearing surface 35 complementary to the under beveled bearing surface 12 of the pail lugs 10. The flange lugs 33 are of a length slightly less than the space between pail lugs 10, and, in this embodiment, are 10 in number. The pail lug bearing surface 35 is substantially parallel to the plane of the nose 29 and, when mounted, the plane of the rim 7 of the pail.

A tubular annular gasket 40 is seated in the channels 28. The nose 29 is positioned radially between the channels 28, and also between the ribs 8 and 14 of the pail rim when the lid is mounted.

Figure 3:
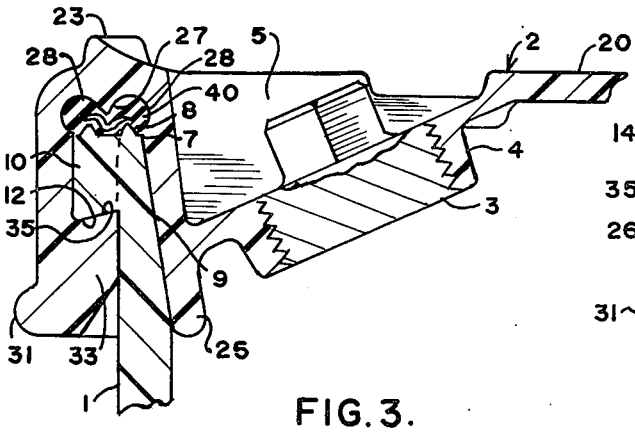
FIG. 3 is a sectional view taken along the line 3—3 of FIG. 1.
Figure 4:
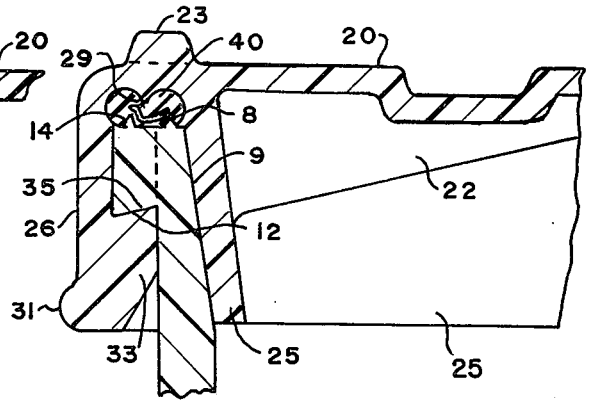
FIG. 4 is a sectional view taken along the line 4—4 of FIG. 1.
Figure 5:
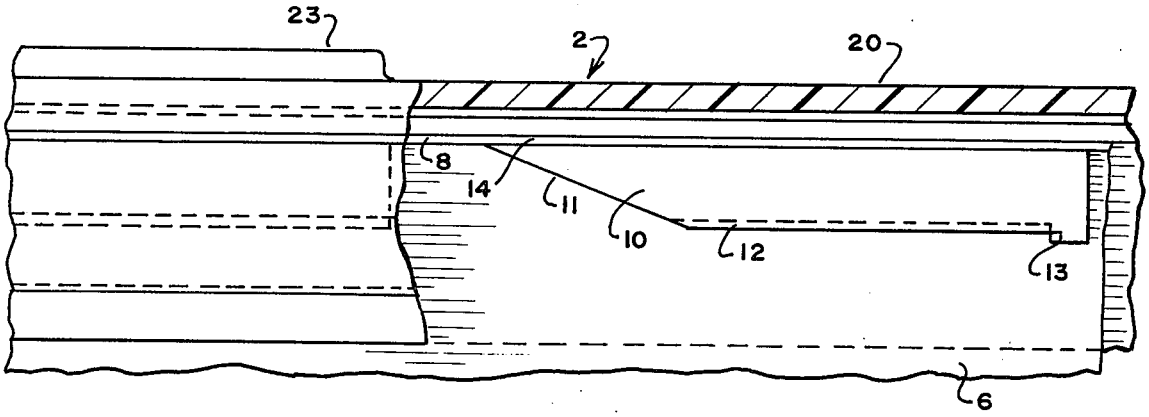
FIG. 5 is a fragmentary enlarged view in side elevation, partly broken away, in a direction indicated by the line 5—5 of FIG. 1.
Figure 6:
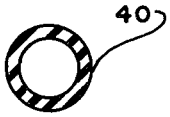
FIG. 6 is a sectional view of a gasket member.
Figure 7:
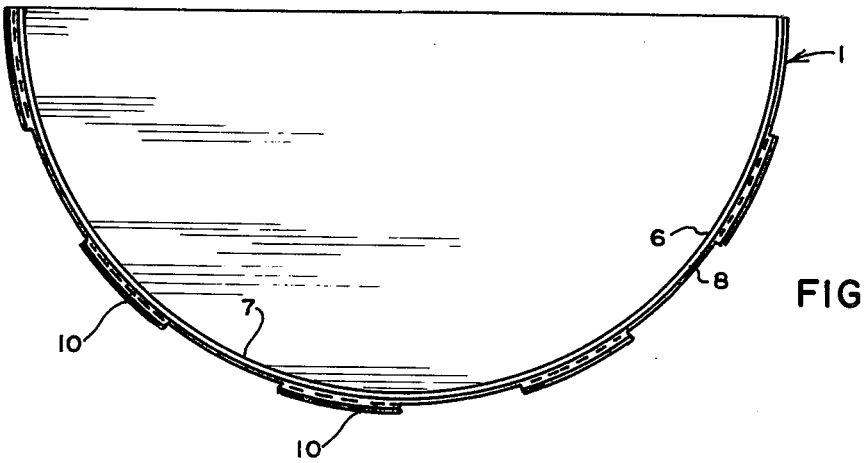
FIG. 7 is a top plan view of half of the pail of the assembly shown in FIG. 1.

As can be seen in FIGS. 3 and 4, when the lid 2 is mounted on the pail, the gasket 40 is compressed between the rim of the pail and the bottom wall of the lid channel, and particularly between the ribs 8 and 14 and the nose 29.

The bosses 23 serve at least a dual purpose in the embodiment shown. First, they are positioned and dimensioned coincidentally with the flange lugs 33, so as to give an immediate indication of the position of the flange lugs, and second, they are useful in the mounting and demounting of the lid as will be explained hereinafter. One or more of them may be embossed otherwise imprinted with directions for mounting and demounting the lid, as shown particularly in FIG. 1.

In mounting the lid on the pail of the assembly described, the lid, with the gasket 40 in place, is placed on the pail with the flange lugs 33 positioned in the space between the pail lugs 10. The pail is held against rotation, and the lid is rotated in the proper direction. The flange lugs cam down the cam surface of the pail lugs, compressing the gasket 40, until they reach the bearing surface 12, when they will move without further compression until they hit the stop 13.

In this condition, they will not shake loose, because the bearing surfaces 12 and 35 are substantially parallel with the rim, and the under beveling of the two surfaces interlocks them against any radial movement. It is even possible to put a slight slope on the bearing surfaces toward the rim in the direction of the stop 13 of the pail lugs and the corresponding end of the flange lugs, but that has not been found to be necessary. The term substantially parallel to the rim encompasses such a construction as distinguished from a slope the other direction, which would admit of gradual loosening of the lid if the pails are subjected to vibration.

In mounting the lid, the bosses 23 can be used by laying a flat rectangular bar long enough to permit a handhold to be had on either side, diametrically across the lid between the bosses 23 on opposite sides of the lid, and by pushing down slightly and turning the bar against the adjacent boss, turning the lid relative to the pail.

In removing the lid, the pail is again held against rotation, a similar bar can be placed across the lid, some downward pressure is exerted, and the lid rotated in the counter direction to its mounting direction. In the embodiment shown, the assembly has been shown with the pail lugs arranged in such a way that the lid is turned counter-clockwise, viewed in top plan, for mounting, and clockwise for demounting, but it could be as easily arranged for the opposite direction.

If for some reason the lid gets struck, a tap on the bosses with a mallet will break it loose, the resilience of the gasket permitting a slight relative movement of the lid and pail.

Numerous variations in the construction of the pail assembly of this invention, with the scope of the appended claims, will occur to those skilled in the art in light of the foregoing disclosure. Merely by way of example, the numbers of pail lugs and flange lugs, while preferably the same, can be varied from a minimum of two to a maximum determined only by practical considerations. If it is desired, for some reason, to orient the lid and pail in a particular relationship, one of the lid flange lugs can be made larger than the others, and the spacing of two adjacent pail lugs made wider to accommodate it, which will ensure that it is insertable in only one space. That same object can be accomplished in other ways, as by positioning one lug assymetrically, without changing its size. Provision can be made on the pail, by way of projecting lug or the provision of a well, for example, to facilitate the use of a fixture or tool to hold the pail against movement relative to the lid, or the lid can be held against movement and the pail twisted. Other means in lieu of or in addition to the bosses 23 can be provided on the lid for receiving a type of spanner or other tool. Other sealing means, besides the tubular gasket can be used, such as soft foamed gasketing or even an integral blister in the channel, or the ribs and nose can be constructed to engage one another tightly. The pail can be made of material different from plastic. These variations are merely illustrative.

Having thus described the invention, what is claimed and desired to be secured by Letters Patent is:

1. In a pail assembly including a pail having a side wall with a rim circular in top plan, and a plastic lid capable of being sealingly mounted on said pail, the improvement comprising an annular rib extending uninterruptedly around the pail rim, a plurality of peripherally spaced pail lugs on and integral with said side wall adjacent the said rim, each of said pail lugs having a rib parallel to, in the same plane with, and spaced outwardly radially from the uninterrupted rib of the rim, and, along its lower surface at one end an inclined cam surface tending away from said rim; said lid having an internal annular skirt on, integral at and along its upper edge with and depending from said lid, and of a shape and outside diameter complementary to the inside surface of the pail side wall adjacent said rim for engaging one another snugly when said lid is mounted on said pail, annular flange integral with said lid, spaced outwardly radially of said skirt and defining with said skirt a channel having a closed bottom wall and an open mouth, said bottom wall having an annular nose, projecting from the bottom wall toward the open mouth, which, when the lid is mounted, is positioned radially between the uninterrupted rim rib and the lug rib, a plurality of peripherally spaced radially inwardly extending flange lugs integral with said flange and spaced outwardly from said closed bottom wall toward said open mouth, of a peripheral length less than the space between successive pail lugs with which said flange lugs are to engage, said flange lugs having a bearing surface extending radially inwardly and shaped and positioned to engage a pail lug bearing surface, said nose, side walls of the flange and skirt bottom wall defining a gasket seat, and an annular gasket seated in said seat, said gasket being compressed between said nose and said ribs when the lid is mounted on the pail.

2. The improvement of claim 1 wherein the inside surface of the pail side wall adjacent the rim is sloped radially inwardly in the direction away from the rim, and the annular lid skirt is sloped complementarily thereto.

3. The improvement of claim 1 wherein the bearing surface of the pail lugs and flange lugs are under beveled toward the rim in a direction radially inwardly.

4. The improvement of claim 1 including gussets integral with the web of the lid and with the radially inner side wall of the lid skirt, said gussets terminating short of the outer margin of said skirt.

5. The improvement of claim 1 wherein the bearing surfaces of the pail lugs and flange lugs are under beveled toward the rim in a direction radially inwardly, and the pail lugs include a stop at an end of the lug opposite from the cam surface.

* * * * *